US010401043B2

(12) United States Patent
Li

(10) Patent No.: US 10,401,043 B2
(45) Date of Patent: Sep. 3, 2019

(54) HIGH EFFICIENCY FLIPPING WINDOW-BRIDGE AIR CONDITIONERS AND HEAT PUMPS

(71) Applicant: Hu An Li, Oakland Gardens, NY (US)

(72) Inventor: Hu An Li, Oakland Gardens, NY (US)

( * ) Notice: Subject to any disclaimer, the term of this patent is extended or adjusted under 35 U.S.C. 154(b) by 0 days.

(21) Appl. No.: 16/101,482

(22) Filed: Aug. 12, 2018

(65) Prior Publication Data

US 2019/0063760 A1 Feb. 28, 2019

Related U.S. Application Data

(60) Provisional application No. 62/605,863, filed on Aug. 31, 2017.

(51) Int. Cl.
*F24F 1/62* (2011.01)
*F24F 1/32* (2011.01)

(52) U.S. Cl.
CPC . *F24F 1/62* (2013.01); *F24F 1/32* (2013.01)

(58) Field of Classification Search
CPC ..... F24F 1/62; F24F 1/32
See application file for complete search history.

(56) References Cited

U.S. PATENT DOCUMENTS 5,582,025 A * 12/1996 Dubin ..... F24F 1/0003 248/544
6,568,201 B1 * 5/2003 Cur ..... F24F 1/027 62/262
7,040,101 B2 * 5/2006 Takeda ..... A61L 9/22 62/78
2012/0137499 A1 * 6/2012 Agnihotri ..... F16M 11/10 29/462

* cited by examiner

*Primary Examiner* — Ana M Vazquez

(57) ABSTRACT

The present invention, high efficiency flipping window-bridge air conditioners and heat pumps, generally relates to air conditioners and beat pumps. It follows the same operating theory as that of ductless mini-split air conditioners and heat pumps currently on the market. The main advantages of the current invention are high efficiency and easy installation. What is invented is that an indoor unit and an outdoor unit are linked via a frame as one package before the package is mounted and installed in a window opening. The outdoor unit is flexibly connected to the frame by joints and bars; thereby, the outdoor unit is flipped from a horizontal position to a downward vertical position and vice versa, and remain secured in the downward vertical position. The indoor unit is slidably connected to the frame by sliding chutes.

2 Claims, 4 Drawing Sheets

HIGH EFFICIENCY FLIPPING WINDOW-BRIDGE AIR CONDITIONERS AND HEAT PUMPS

CROSS REFERENCE TO RELATED APPLICATION

This application claims the benefit of provisional patent application No. 62/605,863 filed Aug. 31, 2017, entitled HIGH EFFICIENCY FLIPPING WINDOW-BRIDGE AIR CONDITIONERS AND HEAT PUMPS. Which provisional patent application is incorporated by reference in its entirety.

BACKGROUND

Technical Field

The present invention generally relates to air conditioners and heat pumps. More particularly, it relates to ductless air conditioners and heat pumps installed in a window opening of a structure.

Description of Prior Art

Window-mounted air-conditioners are often low efficient because their sizes are limited by the dimensions of the window opening. In addition, they generally do not come with heat pumps and therefore are suitable only for summer use. Moreover, most air conditioners are mounted at the lower window opening and secured by the upper window flame. Consequently, sunlight is blocked, window-view cannot be enjoyed and the upper window cannot be opened. What's more, window-mounted air-conditioners tend to be very noisy in operation. Therefore, a need exits for high efficiency window-mounted air conditioners and heat pumps which do not have the aforementioned drawbacks.

BRIEF SUMMARY

What is invented is high efficiency ductless air conditioners and heat pumps which are installed in a window opening of a structure. Specifically, it is a combination of an indoor unit, an outdoor unit and a frame which links the indoor unit and the outdoor unit together as one package. The frame is mounted over the sill of the window opening, as a bridge with the indoor unit inside of the structure and the outdoor unit outside of the structure. One feature distinguishes the present invention from prior art is that the indoor unit, the outdoor unit and the frame are linked as one package before the package is mounted and installed in the window opening.

Another feature distinguishes the present invention from prior art is that the outdoor unit is flexibly connected to the frame by two joints on each of two opposite sides of the outdoor unit. The two joints form an invisible axis on which the outdoor unit revolves. Thereby, to mount the outdoor unit to its operating position outside of the window opening, raise the whole package consisting of the outdoor unit, the indoor unit and the frame to the window level, push the outdoor unit through the window opening while the outdoor unit is in a horizontal position. After the outdoor unit is outside the window opening and the frame mounts over the window sill, flip the outdoor unit from the horizontal position to a downward vertical position.

An additional feature differentiates the current invention from prior art is that the outdoor unit is further linked to the frame on each of the two opposite sides of the outdoor unit by two sets of bars, each set comprising two bars. On each of the two opposite sides of the outdoor unit, the outdoor unit, the frame and the two bars form a planar four-bar mechanism. When the two bars are locked into a straight line on each of the two opposite sides of the outdoor unit, the outdoor unit remains secured in the downward vertical position. Thereby, to secure the outdoor unit to the downward vertical operating position, once the outdoor unit is outside of the window opening, flip the outdoor unit from the horizontal position to the downward vertical position, insert lock pins into the overlapping area of the two bars. To take the outdoor unit from outside of the window opening inside, remove the lock pins, flip the outdoor unit from the downward vertical position to a horizontal position and pull the outdoor unit inside through the window opening.

Still another feature of the current invention is how the distance between the indoor unit and the outdoor unit is adjusted to fit different wall depths. The indoor unit is slidably connected to the frame via sliding chutes; thereby the indoor unit is slided towards or away from the outdoor unit. Once the distance between the indoor unit and the outdoor unit is desirable, insert lock pins into the sliding chutes to prevent the sliding chutes from further sliding. To dispose the indoor unit to its operating position after mounting and securing the outdoor unit outside the window opening, slide the indoor unit via the sliding chutes back and forth until the distance between the indoor unit and the outdoor unit is desirable, then insert the lock pins into the sliding chutes.

The present invention provides the following advantages;

The current invention can achieve high efficiency: AC unit up to 23 seer and heat pump up to 11 HSPF. Since the outdoor unit is flipped from a horizontal position to a downward vertical position and vice versa, the length of the outdoor unit is not limited by the dimensions of the window opening. Therefore, the outdoor unit can have a large condenser and have coils with large surface; thereby, high efficiency can be achieved.

The present invention is easy and safe to install and remove. No professional knowledge in HVAC is needed. No excessive labor is required.

In addition, the current invention works quietly. Furthermore; since the frame is only a few inches in height, lower windows can be opened, window-view can be enjoyed and more light can go through the window opening.

BRIEF DESCRIPTION OF THE DRAWINGS

Specific embodiments of the invention will now be described below with reference to the accompanying: drawings in which.

DETAILED DESCRIPTION

Figure 1:
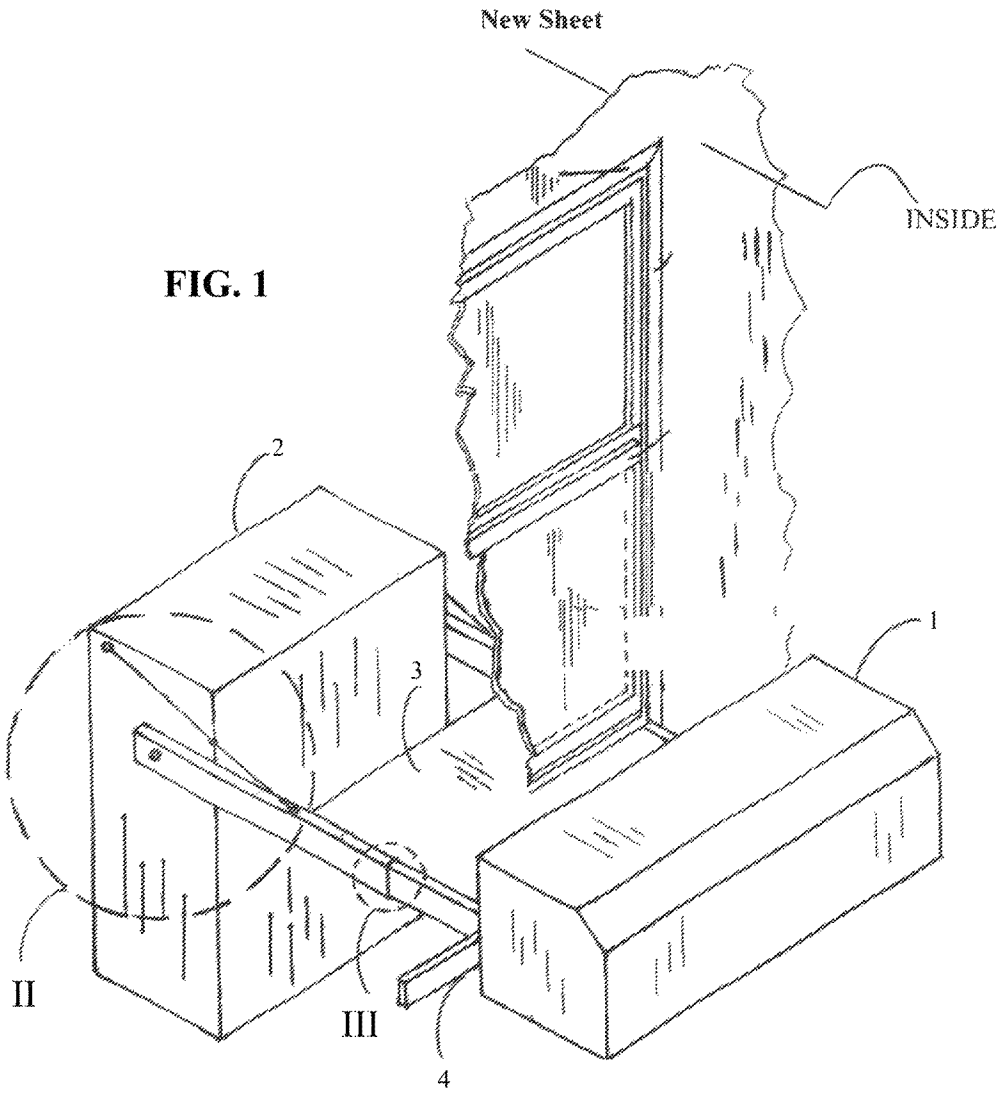
FIG. 1 is a perspective view of the indoor unit, the outdoor unit and the frame shown in place in a window opening of a structure, the window being broken away.

A detailed description is as follows:

As shown in FIG. 1, an indoor unit 1 and an outdoor unit 2 are linked together via a frame 3 as one package. The frame 3 is mounted over the sill of a window opening of a structure, like a bridge with the indoor unit 1 inside of the structure and the outdoor unit 2 outside of the structure. One feature distinguishes the present invention from prior art is that the indoor unit 1, the outdoor unit 2 and the frame 3 are already linked as one package before the package is mounted in the window opening.

Figure 2:
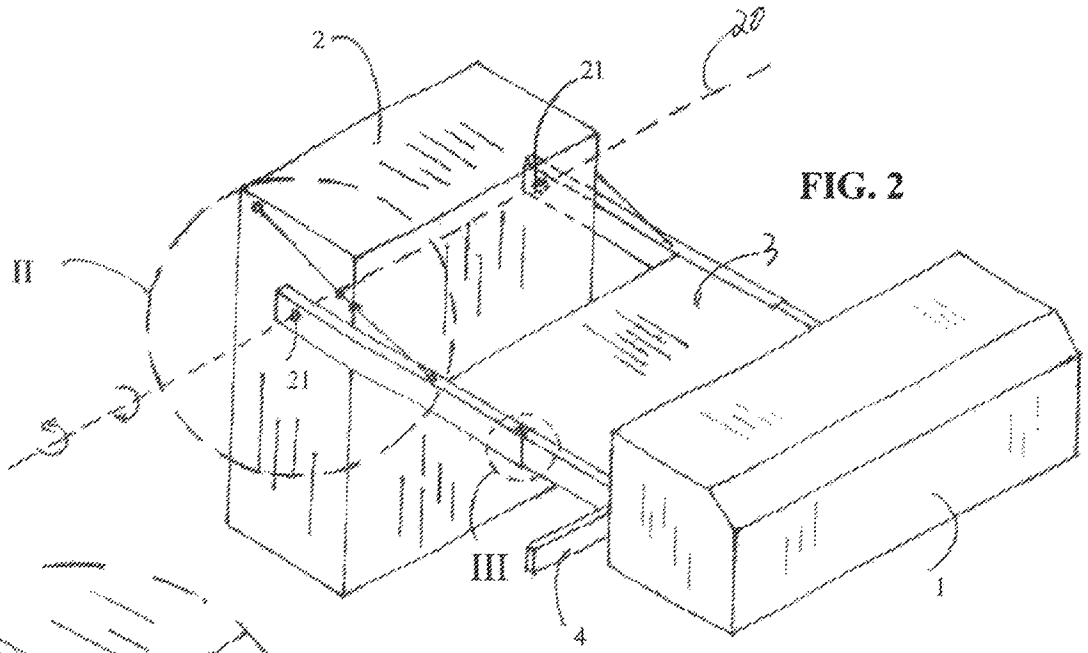
FIG. 2 is a view similar to FIG. 1, but showing the outdoor unit revolving on an invisible axis.

As demonstrated by FIG. 2, on each of two opposite sides of the outdoor unit 2, the outdoor unit 2 is flexibly connected to the frame 3 by joints 21. The joints 21 on the two opposite sides of the outdoor unit 2 form on an invisible axis 20 around which the outdoor unit 2 revolves.

Figure 3:
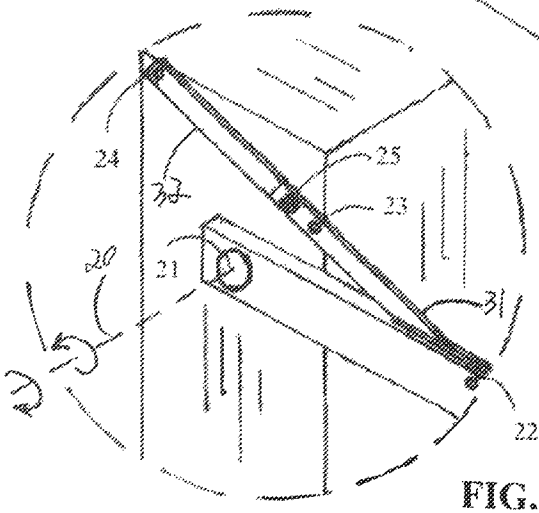
FIG. 3 is a detail of the region II of FIG. 1 and FIG. 2.

As shown by FIG. 2 and FIG. 3, on each of the two opposite sides of the outdoor unit 2, the outdoor unit 2 is flexibly connected to the frame 3 by two bars 31 and 32. Thereby, the outdoor unit 2, the frame 3 and the two bars 31 and 32 constitute a planar four-bar linkage on each of the two opposite sides of the outdoor unit 2. Each of the two planar four-bar mechanisms contains four joints 21, 22, 23 and 24. The first joint 21 connects the outdoor unit 2 to the frame 3. The second joint 22 links the frame 3 with one bar 31. The third joint 23 connects the two bars 31 and 32. The fourth joint 24 links the outdoor unit 2 with the other bar 32.

Figure 6B:
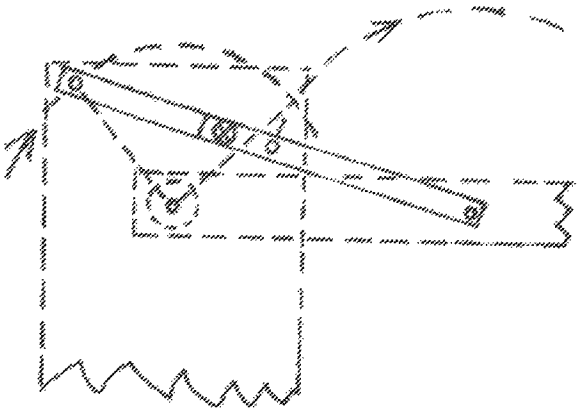
FIG. 6B is a view similar to FIG. 6A without the joints and the bars numbered.
Figure 5A:
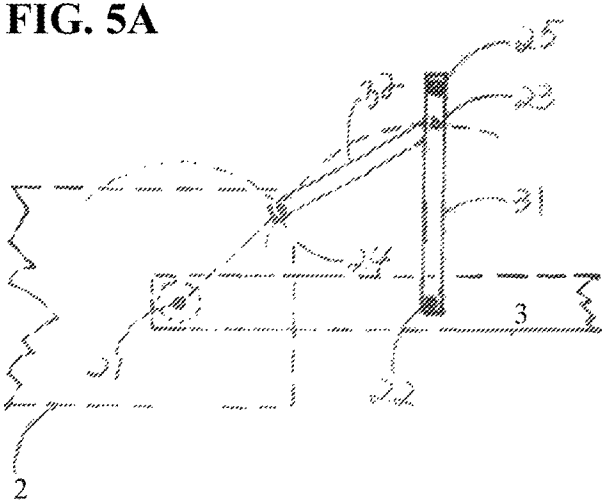
FIG. 5A is a perspective view showing the movement of the planar four-bar linkage with the outdoor unit in a horizontal position.
Figure 6A:
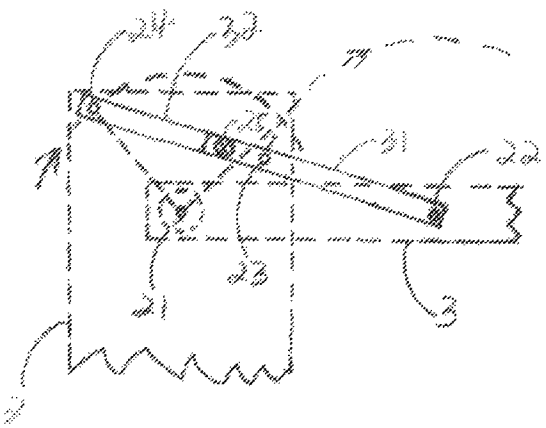
FIG. 6A is another perspective view showing the movement of the planar four-bar linkage with the outdoor unit in a downward vertical position.

FIG. 5A, FIG. 5B, FIG. 6A and FIG. 6B further demonstrate the movement of the planar four-bar linkages. When the frame 3 is in a horizontal position, the outdoor unit 2 is flipped from a horizontal position to a downward vertical position and vice versa. As shown in FIG. 6A and FIG. 6B, when the outdoor unit 2 is in a downward vertical position, the two bars 31 and 32 are in a straight line. To secure the outdoor unit 2 in the downward vertical position, insert lock pins into the overlapping area 25 of the two bars 31 and 32.

Figure 4:
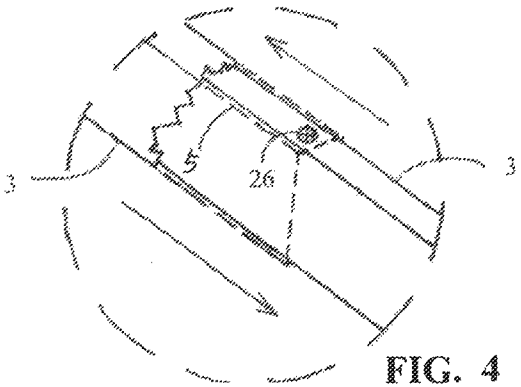
FIG. 4 is a detail of the region III of FIG. 1 and FIG. 2.
Figure 5B:
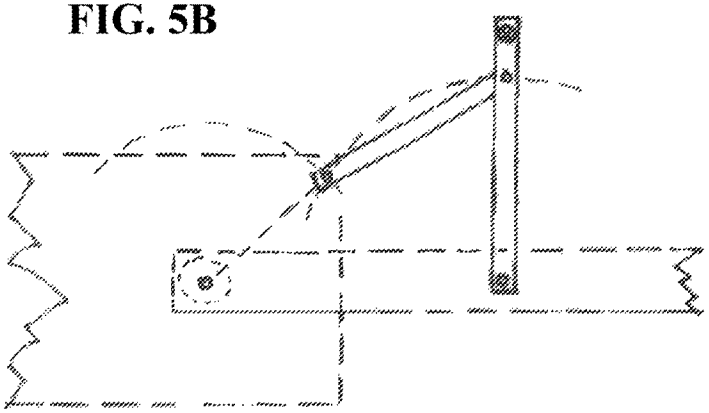
FIG. 5B is a view similar to FIG. 5A without the joints and the bars numbered.
Figure 7:
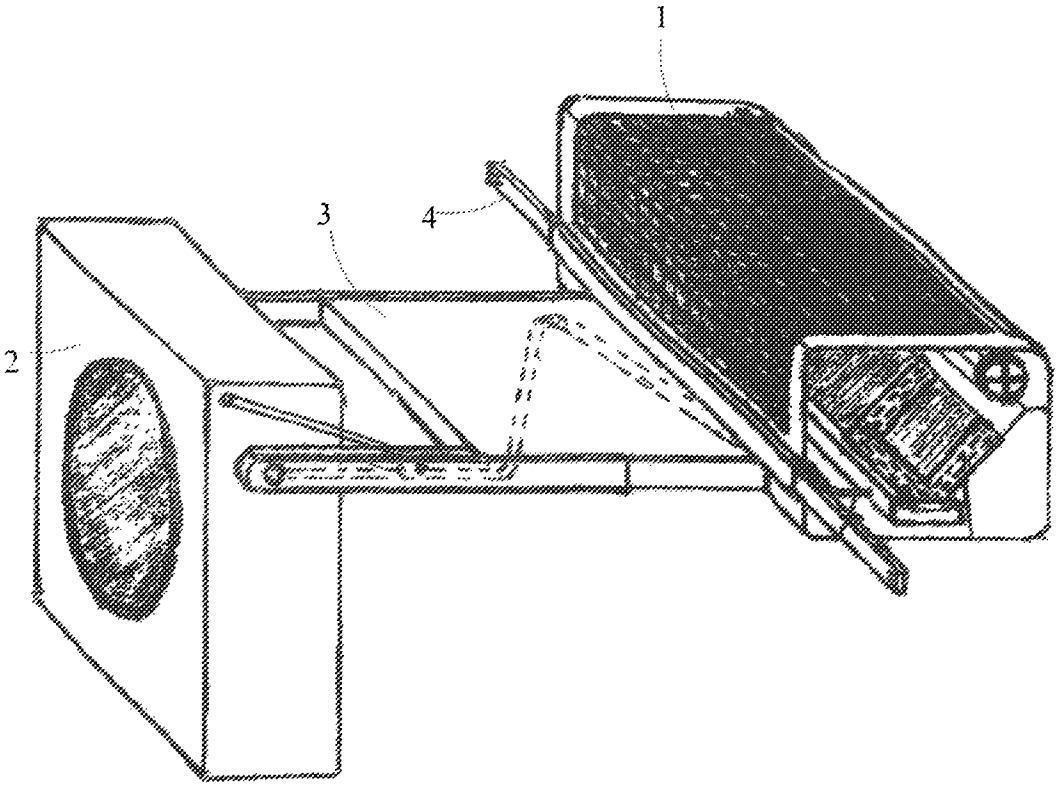
FIG. 7 is another perspective view illustrating the security bar.

As FIG. 2 and FIG. 4 illustrated, the indoor unit 1 is slidably connected to the frame 3 via sliding chutes 5 on each of two opposite sides; thereby the indoor unit 1 is slided towards or away from the outdoor unit 2. Once the distance between the indoor unit 1 and the outdoor unit 2 is desirable, insert lock pins into the overlapping area 26 of the sliding chutes 5 to prevent further sliding. As can be seen from FIG. 7, the indoor unit 1 is further secured to its operating position by affixing the security bar 4 to the window opening.

Hence, to mount and install the entire package over the window opening is very easy. Raise the whole package to the window level, push the outdoor unit 2 through the window opening while the outdoor unit 2 is in a horizontal position. Once the outdoor unit 2 is outside of the window opening, flip the outdoor unit 2 from the horizontal position to a downward vertical position, and insert lock pins into the overlapping area 25 of the two bars 31 and 32 to secure the outdoor unit 3 in the downward vertical position. Then slide the indoor unit 1 via the sliding chutes 5 back and forth until the distance between the indoor unit 1 and the outdoor unit 2 is desirable, insert the lock pins into the overlapping area 26 of the sliding chutes 5 to prevent further sliding. Affix the security bar 4 to the window opening to further secure the indoor unit 1.

Similarly, to uninstall the package is very easy. Detach the security bar 4 from the window opening. Remove the lock pins inserted into the overlapping area 25 of the two bars 31 and 32 and the lock pins inserted into the overlapping area 26 of the sliding chutes 5. Flip the outdoor unit 2 from the downward vertical position to a horizontal position and pull the outdoor unit 2 inside through the window opening.

What is claimed is:

1. Air conditioner and heat pump installed in a window opening of a structure; comprising:

An indoor unit;

An outdoor unit;

A frame;

Wherein said indoor unit, said outdoor unit and said frame are connected together as one package with said frame configured to link said indoor unit and said outdoor unit as a bridge; before said package is mounted over said window opening;

Said outdoor unit flexibly connected to said frame by two joints; wherein said two joints configured to form an invisible axis; wherein said outdoor unit configured to revolve on said invisible axis; whereby said outdoor unit configured to go through said window opening in a horizontal position, said outdoor unit configured to flip from said horizontal position to a downward vertical position after said outdoor unit is outside said window opening and said frame mounted over a window sill;

Said outdoor unit further linked to said frame by two sets of bars, each set comprising two bars; wherein said outdoor unit, said frame and said two bars configured to form a planar four-bar mechanism; wherein each planar four-bar mechanism comprising four joints; wherein one joint of said planar four-bar mechanism being one of said two joints configured to form said invisible axis and configured to connect said outdoor unit with said frame, another joint of said planar four-bar mechanism configured to link said frame with one bar, another joint of said planar four-bar mechanism configured to connect said two bars, another joint configured to link said outdoor unit with said other bar; wherein said two bars of each of said two sets being locked into a straight line, to secure said outdoor unit to said downward vertical position outside of said window opening while said frame is mounted over said window sill.

2. The air conditioner and heat pump installed in said window opening of said structure as described in claim 1, further comprising said indoor unit adjustably connected to said frame via sliding chutes; wherein said indoor unit configured to slide in opposite directions towards or away from said outdoor unit to fit different wall widths; wherein said sliding chutes being locked for securing said indoor unit at a desirable distance from said outdoor unit.

* * * * *